US007249858B2

(12) United States Patent
Blackwood

(10) Patent No.: US 7,249,858 B2
(45) Date of Patent: Jul. 31, 2007

(54) HEAT STORAGE EQUIPMENT FOR MIRRORS

(76) Inventor: Miles Blackwood, 3 Flint Court, Buderim, Queensland (AU) 4556

( * ) Notice: Subject to any disclaimer, the term of this patent is extended or adjusted under 35 U.S.C. 154(b) by 0 days.

(21) Appl. No.: 10/766,397

(22) Filed: Jan. 23, 2004

(65) Prior Publication Data

US 2004/0156107 A1 Aug. 12, 2004

(30) Foreign Application Priority Data

Mar. 8, 2002 (AU) ..... PR6782
Jun. 12, 2002 (WO) ..... PCT/AU02/00942

(51) Int. Cl.
*G02B 1/00* (2006.01)

(52) U.S. Cl. ..... 359/509

(58) Field of Classification Search ..... 359/507, 359/509, 845
See application file for complete search history.

(56) References Cited

U.S. PATENT DOCUMENTS 4,655,559 A 4/1987 Odell
4,733,468 A 3/1988 Zadio
4,832,475 A 5/1989 Daniels
5,032,015 A * 7/1991 Christianson ..... 359/507
5,094,519 A * 3/1992 Ealey et al. ..... 359/845
5,604,633 A * 2/1997 Christianson ..... 359/507

FOREIGN PATENT DOCUMENTS

GB 2129295 5/1984

* cited by examiner

*Primary Examiner*—Euncha P. Cherry
(74) *Attorney, Agent, or Firm*—Olive & Olive, P.A.

(57) ABSTRACT

Compact features provide faster and more efficient gathering and storage of a sufficient reservoir of heated water to heat a shaving mirror to non-fogging temperature. The features are arranged on the vertical surfaces of the mirror to enable water to enter the reservoir over a large surface area relative to the mirror size.

6 Claims, 1 Drawing Sheet

HEAT STORAGE EQUIPMENT FOR MIRRORS

This invention relates to heated mirrors.

Mirrors for use in steamy atmospheres where condensation affects visibility, for example in showers and bathrooms, can be warmed above condensation temperature by applying hot water that is readily available from the shower or the hand basin. Mirrors are known that employ a reservoir behind the mirror surface for filling with hot water. However, these known mirrors are bulky and lack utility because the reservoir is difficult to fill.

This invention is more particularly concerned with mirror equipment of the type that is manipulated by hand at each use in order to apply hot water to the mirror.

An example of such equipment is known from patent specification U.S. Pat. No. 4,655,559. In that known equipment, the mirror is provided on the front of a reservoir, from the bottom of which a pin projects. The pin fits into a socket in a bracket, which is connected by a ball and a socket joint to a sucker for attachment to a wall. By disconnecting the pin and socket joint, the mirrored reservoir can be removed for emptying and recharging with hot water to reduce the tendency of the mirror to fog-up. The equipment of U.S. Pat. No. 4,655,559 requires the user to remove the mirror from its support then fill the reservoir by holding its open end in the shower water flow, or by immersing it in a hand basin or the like. The reservoir must be emptied before reuse. However, when a single cavity is filled with water in this way it is difficult to get the water to flow into the cavity. For convenience, the water entry area must be large enough to allow water to flow easily into the cavity in a reasonable time. Therefore, the water volume in the single cavity must be greater than is required for heating the mirror surface. This difficulty arises because the water attempts to enter the cavity from a generally restricted entrance aperture at one end of the cavity, but it is prevented from entering by the air trying to expel from the cavity. Furthermore, when filled from a shower spray the reservoir opening must be unduly large in order to catch the dispersed drops of water. When emptying the cavity, the water is hampered in its egress by a combination of capillary action and the blocking effect of air flowing into the cavity. If the water entry point is made larger to achieve a convenient filling rate of the reservoir, the whole device must be made correspondingly larger.

When constructing a portable heated mirror device it is desirable that the construction be as slimline as practicable, so that the equipment may be easily stored in a shaving kit bag for example. Also, it is desirable that the equipment be a light as practicable when charged with water so that sucker type support devices are more effective.

In accordance with one aspect of the present invention, a heated mirror of the general type mentioned above is characterised in that the mirror is provided with features disposed behind the mirrored surface for gathering water, and structures disposed behind the mirrored surface for retaining water, wherein the water gathering features are several and are adjacent at least part of the surface area of the back of the mirror, and wherein the water retaining structures are several, and extend outward from adjacent the mirrored surface to form a generally open compartment such that the compartment so formed may be filled with water, which structures cover at least part of the back of the mirror.

By virtue of the relatively large surface area available for the water to enter into the reservoir, it is filled almost instantly when exposed to the shower spray or immersed in water.

In another embodiment, the mirror is provided with an absorbent material disposed behind the mirrored surface wherein the material may absorb heated water so that the heat in the water can be transferred to the body of the mirror over time. By virtue of the relatively large surface area for the water to enter into the absorbent material, it is filled almost instantly when exposed to the shower spray or immersed in water.

In another embodiment the mirror material may be provided with cavities over the surface area of the mirror so that these can adsorb or be filled with heated water so that the heat in the water can be transferred to the mirror body over time.

By incorporating such a water storage device, a water heated mirror that includes a water reservoir may be made more convenient for the user due to the quickness of the filling and emptying of the water reservoir. When showering, the user does not have to present a filling aperture precisely to the water source but merely waves the larger collecting surface of the present invention under the general water flow. Further, the mirror may be constructed to be less bulky, lighter in weight, especially when charged with water, and more portable, for fitting into a shaving kit bag for example.

BRIEF DESCRIPTION OF THE DRAWINGS

Specific embodiments of the present invention will now be described, by way of example, with reference to the accompanying drawings, in which.

DETAILED DESCRIPTION

Figure 1:
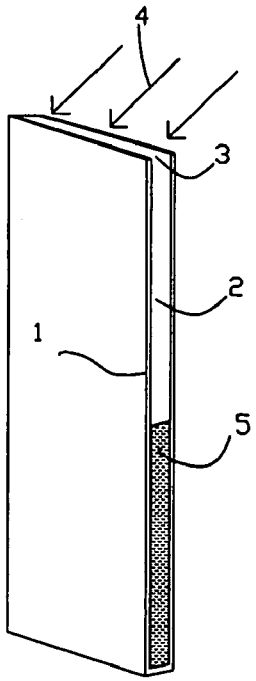
FIG. 1 is a sectioned view illustrating difficulties of filling water reservoirs in shaving mirrors.

The problems experienced when filling water reservoirs, in particular those associated with water-heated mirrors of the prior art, are demonstrated in FIG. 1. The size of the mirror [1] may vary, but at least 150 mm of mirror height and 100 mm of width is required to efficiently accommodate the facial reflection when shaving or removing make-up for instance. Thus, the function of the equipment dictates that the height and width of the reservoir [2] must be approximately proportional to those shown in FIG. 1. In FIG. 1, the effective area available for water [5] gathering is the opening [3] where the water flow [4] enters the water storage reservoir [2]. Increasing the size of the opening [3] is not practical for gathering water [5] from a shower head water flow [4] because the geometry of the water flow from shower heads does not fit the shape of the reservoir entrance [3], and to compound this problem the individual water jets are spaced too far apart to supply the water volume needed when only a relatively small gathering aperture is available.

Figure 2:
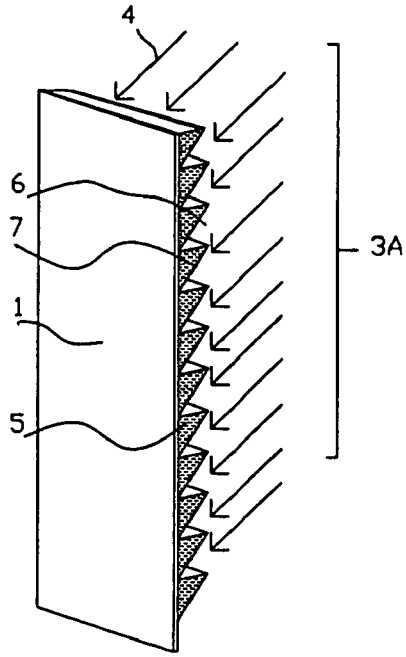
FIG. 2 is a sectioned view of an embodiment with compartmented water gathering and retaining features on the back vertical surface of the mirror.

FIG. 2A shows equipment of the present invention where water [5] gathering features [6] and cellular water retaining structures [7] cover the back of the mirror [1]. The effective area available for water gathering is the area [3A] where water flow [4] enters the water storage structures [7] over a major portion of the mirror back. The water gathering features [6] are comprised of the spaces between the louvre-like water retaining structures [7]. The cells bounded by the structures [7] are filled almost instantly by the water flow [4] because of their generally open aspect. The copious flow of water into the cells bounded by the retaining structures [7], and the resultant overflow of the cells, ensures that the initial coldness of the equipment is removed quickly, and the final reservoir of water will be more effective in maintaining a fog-free state for a longer period.

It will be appreciated that although louvres are shown in a generally linear configuration in the drawing, the water gathering features and retaining structures can be of any suitable shape.

Figure 3:
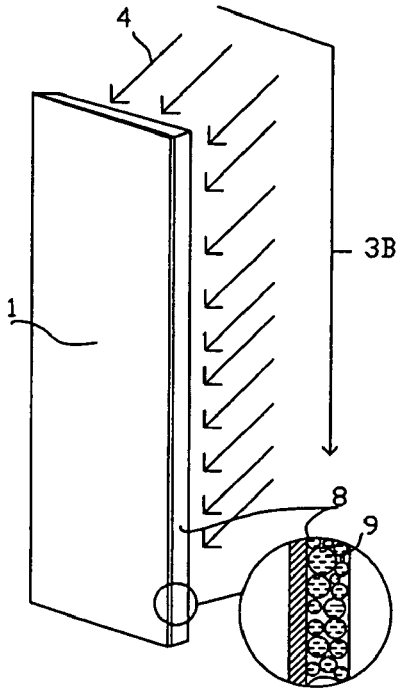
FIG. 3 is an oblique view of a second embodiment with cellular water gathering and retaining structures on the rear vertical surface of the mirror and incorporates a magnified section.

In a further embodiment of the invention, FIG. 3 shows a cellular configuration of water gathering and storage where a large surface area for water gathering is provided by a sponge like material [8] adjacent the back vertical surface of the mirror [1]. In this embodiment the cellular spaces [9] are smaller than the compartments delineated by the water volumes [5] shown in FIG. 2, but they both employ the principle of retaining water on the vertical surface of the mirror assembly and thus provide a substantially larger surface area for ingress of water [4] into the storage means relative to the storage capacity. The sponge material [8] is charged in much the same way as the compartments [7] shown in FIG. 2.

Figure 4:
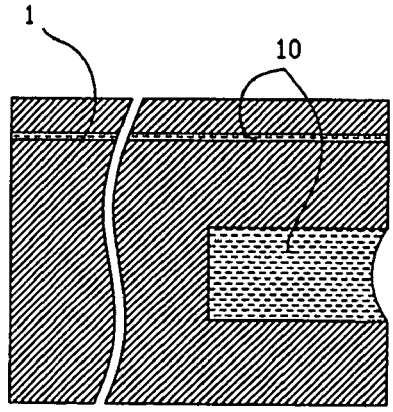
FIG. 4 is a cross-sectional view of a mirror material containing cavities for filling with water

In FIG. 4 the mirror body [1] is provided with cavities [10] on at least one vertical face of the mirror [1] in quantities that in combination present a large surface area for filling relative the surface area of the mirror. These holes or cavities may be relatively large or microscopic. Microscopic holes may be placed partially through the mirror body or right through the mirror body and may be applied in a density that does not unduly affect the reflective qualities of the mirror.

I claim:

1. A detached portable mirror for use in a bathroom, shower or other steamy environment, the mirror including:

a front mirrored surface;

a rear surface; and a plurality of collecting and dispensing means disposed on at least the rear surface for rapid and simultaneous collection of heated water from the environment into each of said means and for retaining and subsequently dispensing the thus collected heated water from said means over at least the rear surface at a rate to maintain the front mirrored surface condensation-free when the mirror is in use in the environment.

2. A mirror as defined in claim 1 wherein each of the collecting and dispensing means is an open-topped reservoir.

3. A mirror as defined in claim 1 wherein each of the collecting and dispensing means is an absorbent material.

4. A mirror as defined in claim 3 wherein the absorbent material has a cellular structure.

5. A mirror as defined in claim 1 wherein each of the collecting and dispensing means is a cavity in the rear surface.

6. A mirror as defined in claim 1 wherein each of the collecting and dispensing means is a bore passing through the front mirrored surface and the rear surface.

* * * * *